US011255160B2

(12) United States Patent
Al-Qasim et al.

(10) Patent No.: US 11,255,160 B2
(45) Date of Patent: Feb. 22, 2022

(54) UNBLOCKING WELLBORES

(71) Applicant: Saudi Arabian Oil Company, Dhahran (SA)

(72) Inventors: Abdulaziz Al-Qasim, Dammam (SA); Amer Alanazi, Dammam (SA); Muataz Hamed Al-Subhi, Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 46 days.

(21) Appl. No.: 16/707,460

(22) Filed: Dec. 9, 2019

(65) Prior Publication Data

US 2021/0172291 A1 Jun. 10, 2021

(51) Int. Cl.

| | |
|---|---|
| ***E21B 37/02*** | (2006.01) |
| ***E21B 41/00*** | (2006.01) |
| ***E21B 47/00*** | (2012.01) |

(52) U.S. Cl.

CPC ..... *E21B 41/00* (2013.01); *E21B 37/02* (2013.01); *E21B 47/00* (2013.01)

(58) Field of Classification Search

CPC ..... E21B 37/00; E21B 37/10; E21B 33/124; E21B 43/103; E21B 43/108; E21B 37/02; E21B 43/08; E21B 43/105; B08B 9/027

See application file for complete search history.

(56) References Cited

U.S. PATENT DOCUMENTS

| | | | | |
|---|---|---|---|---|
| 2,144,944 A | | 1/1939 | Standlee | |
| 3,203,451 A | * | 8/1965 | Vincent | E21B 17/00 138/143 |
| 5,042,297 A | | 8/1991 | Lessi | |
| 5,366,012 A | * | 11/1994 | Lohbeck | E21B 43/086 166/277 |
| 5,517,024 A | | 5/1996 | Mullins et al. | |

(Continued)

FOREIGN PATENT DOCUMENTS

| | | | |
|---|---|---|---|
| CN | 110185415 | | 8/2019 |
| CN | 110185415 A | * | 8/2019 |

OTHER PUBLICATIONS

PCT International Search Report and Written Opinion in International Appln. No. PCT/US2020/063986, dated Mar. 29, 2021, 16 pages.

(Continued)

*Primary Examiner* — Daniel P Stephenson
(74) *Attorney, Agent, or Firm* — Fish & Richardson P.C.

(57) ABSTRACT

A first expandable tubular is longitudinally extendable from a housing. The first expandable tubular is expandable to a diameter equal to an internal surface of a wellbore. A first expander is configured to expand the expandable tubular. A second expandable tubular is longitudinally extendable from the housing. The second expandable tubular is configured to expand to a diameter equal to an internal surface of the wellbore. The second expandable tubular is downhole of the first expandable tubular. A second expander is configured to expand the second expandable tubular. The second expander is downhole of the first expander. A sensor is downhole of the second expander. The sensor is configured to detect a presence of a wellbore obstruction proximal to the tool.

20 Claims, 15 Drawing Sheets

(56) References Cited

U.S. PATENT DOCUMENTS

| | | | | |
|---|---|---|---|---|
| 6,142,230 | A * | 11/2000 | Smalley | E21B 17/02 166/277 |
| 6,854,522 | B2 * | 2/2005 | Brezinski | E21B 33/12 166/387 |
| 6,942,043 | B2 | 9/2005 | Kurkoski | |
| 7,172,027 | B2 * | 2/2007 | Simpson | E21B 23/01 166/207 |
| 7,866,383 | B2 | 1/2011 | Dusterhoft et al. | |
| 9,212,542 | B2 | 12/2015 | Fripp et al. | |
| 2003/0188868 | A1 * | 10/2003 | Simpson | E21B 33/0422 166/298 |
| 2004/0251033 | A1 * | 12/2004 | Cameron | E21B 43/086 166/382 |
| 2007/0095532 | A1 * | 5/2007 | Head | E21B 41/0042 166/277 |
| 2012/0116443 | A1 | 5/2012 | Ferrera et al. | |
| 2013/0081459 | A1 | 4/2013 | Merniche | |
| 2018/0328152 | A1 | 11/2018 | Hart et al. | |
| 2018/0355695 | A1 | 12/2018 | Holland | |

OTHER PUBLICATIONS

GCC Examination Report issued in Gulf Cooperation Council Appln. No. 2020-41054, dated Oct. 13, 2021, 5 pages.

* cited by examiner

UNBLOCKING WELLBORES

TECHNICAL FIELD

This disclosure relates to wellbore cleaning tools.

BACKGROUND

Well logging in hydrocarbon production wells is used to help make important decisions related to well placement, type of intervention to be deployed, and optimizing reservoir depletion strategy. Wellbores are monitored as they are being drilled, by mudlogging and/or measurements while drilling (MWD), or post-drilling operations such as production and saturation logging tools.

SUMMARY

This disclosure describes technologies relating to unblocking wellbores.

An example implementation of the subject matter described within this disclosure is a wellbore tool with the following features. A first expandable tubular is longitudinally extendable from a housing. The first expandable tubular is expandable to a diameter equal to an internal surface of a wellbore. A first expander is configured to expand the expandable tubular. A second expandable tubular is longitudinally extendable from the housing. The second expandable tubular is configured to expand to a diameter equal to an internal surface of the wellbore. The second expandable tubular is downhole of the first expandable tubular. A second expander is configured to expand the second expandable tubular. The second expander is downhole of the first expander. A sensor is downhole of the second expander. The sensor is configured to detect a presence of a wellbore obstruction proximal to the tool.

Aspects of the example implementation, which can be combined with the example implementation alone or in combination, include the following. The first or the second expandable tubular is separable from the wellbore tool.

Aspects of the example implementation, which can be combined with the example implementation alone or in combination, include the following. The first or second expander includes an inflatable bladder.

Aspects of the example implementation, which can be combined with the example implementation alone or in combination, include the following. The first or second expander includes a first cylinder and a second cylinder coaxial to the first cylinder. The first cylinder and the second cylinder are arranged to move between an extended position and a retracted position. The retracted position expands the expandable tubular and the extended position contracts the expandable tubular.

Aspects of the example implementation, which can be combined with the example implementation alone or in combination, include the following. The wellbore tool of claim 1, wherein the first expandable tubular and the second expandable tubular are separably longitudinally actuable from one another.

Aspects of the example implementation, which can be combined with the example implementation alone or in combination, include the following. A third expandable tubular is longitudinally extendable from the housing. The second expandable tubular is configured to expand to a diameter equal to an internal surface of the wellbore. A third expander is configured to expand the second expandable tubular.

Aspects of the example implementation, which can be combined with the example implementation alone or in combination, include the following. The first or second expandable tubular includes a deformable sticky material.

An example implementation of the subject matter described within this disclosure is a method with the following features. A wellbore tool is received by a restricted wellbore. An expandable tubular is extended from the wellbore tool towards a wellbore restriction. The expandable tubular is expanded within the wellbore restriction or downhole of the wellbore restriction. A flow passage is opened within the wellbore responsive to expanding the expandable tubular.

Aspects of the example implementation, which can be combined with the example implementation alone or in combination, include the following. The expandable tubular is a first expandable tubular. The method further includes extending a second expandable tubular from the wellbore tool downhole of the first expandable tubular. The second expandable tubular is expanded.

Aspects of the example implementation, which can be combined with the example implementation alone or in combination, include the following. The second expanded expandable tubular is retracted toward the first expanded expandable tubular. An inner wall of the wellbore is scraped responsive to retracting the second expandable tubular. At least a portion of the restriction is moved towards the first expanded expandable tubular in response to retracting the second expanded expandable tubular.

Aspects of the example implementation, which can be combined with the example implementation alone or in combination, include the following. The restriction is retained in an annular space defined by an outer surface of the second expandable tubular and an inner surface of the first expandable tubular.

Aspects of the example implementation, which can be combined with the example implementation alone or in combination, include the following. Expanding the expandable tubular includes inflating a bladder within the expandable tubular.

Aspects of the example implementation, which can be combined with the example implementation alone or in combination, include the following. The expandable tubular is released from the wellbore tool. The wellbore tool is retrieved.

Aspects of the example implementation, which can be combined with the example implementation alone or in combination, include the following. The restriction is retained in an annular space defined by an outer surface of the expandable tubular and an inner surface of the wellbore.

Aspects of the example implementation, which can be combined with the example implementation alone or in combination, include the following. The expandable tubular and the restriction are retrieved from the wellbore.

An example implementation of the subject matter described within this disclosure is a wellbore tool with the following features. A wellbore tool is within a restricted wellbore. The wellbore tool includes a housing. An expandable tubular is longitudinally extendable from the housing. The expandable tubular configured to expand to a diameter equal to an internal surface of a wellbore. The expandable tubular is separable from the wellbore tool after the expandable tubular is expanded. An expander includes an inflatable bladder configured to expand the expandable tubular. A sensor is configured to detect a presence of a wellbore obstruction proximal to the tool.

Aspects of the example implementation, which can be combined with the example implementation alone or in combination, include the following. The expandable tubular is a first expandable tubular and the expander is a first expander. The wellbore tool further includes a second expandable tubular longitudinally extendable from the housing. The second expandable tubular is configured to expand to a diameter equal to an internal surface of the wellbore. A second expander is configured to expand the second expandable tubular.

Aspects of the example implementation, which can be combined with the example implementation alone or in combination, include the following. A third expandable tubular is longitudinally extendable from the housing. The third expandable tubular is configured to expand to a diameter equal to an internal surface of the wellbore. A third expander is configured to expand the third expandable tubular.

Aspects of the example implementation, which can be combined with the example implementation alone or in combination, include the following. The second expandable tubular and the second expander are separably longitudinally actuable independent from one-another.

Aspects of the example implementation, which can be combined with the example implementation alone or in combination, include the following. The second expander includes a first cylinder and a second cylinder coaxial to the first cylinder. The first cylinder and the second cylinder are arranged to move between an extended position and a retracted position. The retracted position expands the expandable tubular and the extended position contracts the expandable tubular.

Particular implementations of the subject matter described in this disclosure can be implemented so as to realize one or more of the following advantages. Aspects of this disclosure can be used to increase accuracy of well logs and reduce the likelihood of tool loss within a wellbore. Aspects of this disclosure can be used to collect fluid and cutting samples.

The details of one or more implementations of the subject matter described in this disclosure are set forth in the accompanying drawings and the description. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Obstructions associated with cuttings, remaining filter cakes, and organic (for example, waxes, asphaltenes) and inorganic (for example, scales, corrosion products) materials may prevent the logging tools from operating optimally, may cause logging tools to get stuck, or both. Under such circumstances, logging and intervention tools can get damaged, become difficult to retrieve, or in the worst case scenario, get lost in the wellbore. In order to reduce or eliminate such operational hazards, wellbores need to be cleaned to remove such obstructions or restrictions.

This disclosure relates to a method and apparatus to form a bypass through a wellbore that is at least partially blocked or restricted. The apparatus includes an expander and an expandable tubular that can be mounted on a stand-alone bottom hole assembly or at a downhole end of a separate wellbore tool, such as a logging tool. The expander is inserted into or through the obstruction and is expanded to clear the obstructing material within or along a wall of the wellbore. The expander expands to expand the expandable tubular up against the wall of the wellbore. This expanded tubular can hold the obstructing material in place for further operations, or can be retrieved prior to further operations.

Figure 1:
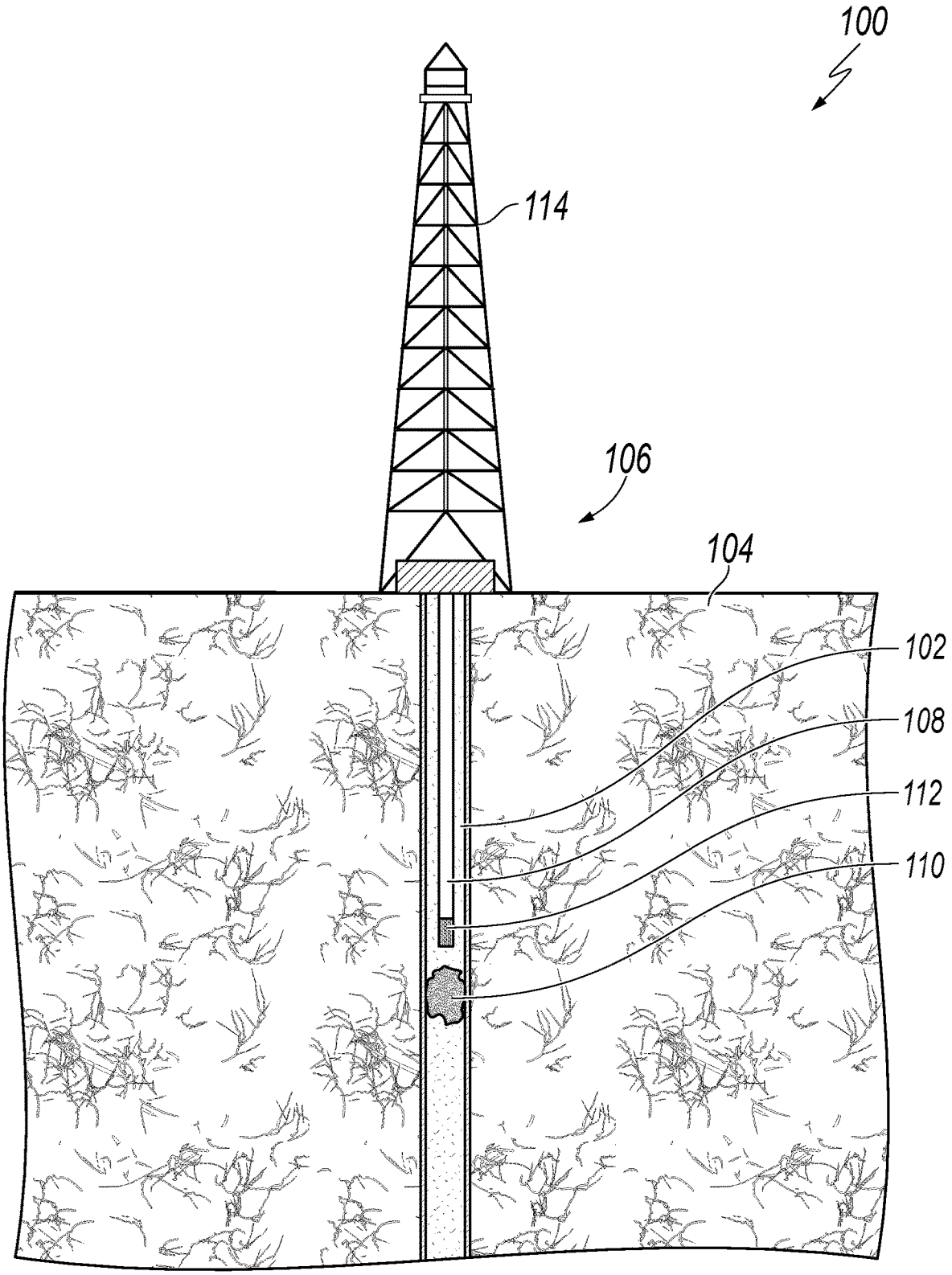
FIG. 1 is a side cross-sectional view of an example wellsite.

FIG. 1 is a side cross-sectional view of an example wellsite 100. The wellsite 100 includes a wellbore 102 formed within a geologic formation 104. At an uphole end of the wellbore is a topside facility 106. The topside facility 106 can include a derrick 114, and any other equipment necessary for performing well operations. While illustrated with a derrick 114, the topside facility 106 can include other intervention systems, such as a wireline or a coiled tubing truck without departing from this disclosure. As illustrated, a restriction or blockage 110 is present within the wellbore 102. The restriction 110 can include cuttings, filter cakes and organic (for example, waxes, asphaltenes) and inorganic (for example, scales, corrosion products) materials, or any other material that may prevent wellbore tools from operating and traversing the wellbore optimally. While illustrated as a vertical wellbore for simplicity, the wellbore 102 can include a horizontal, deviated, or sidetracked wellbore without departing from this disclosure. In order to traverse the restriction, a wellbore tool 112 traverses the wellbore at a downhole end of a work-string 108. The wellbore tool 112 is capable of penetrating and at least partially removing the blockage 110.

Figure 2:
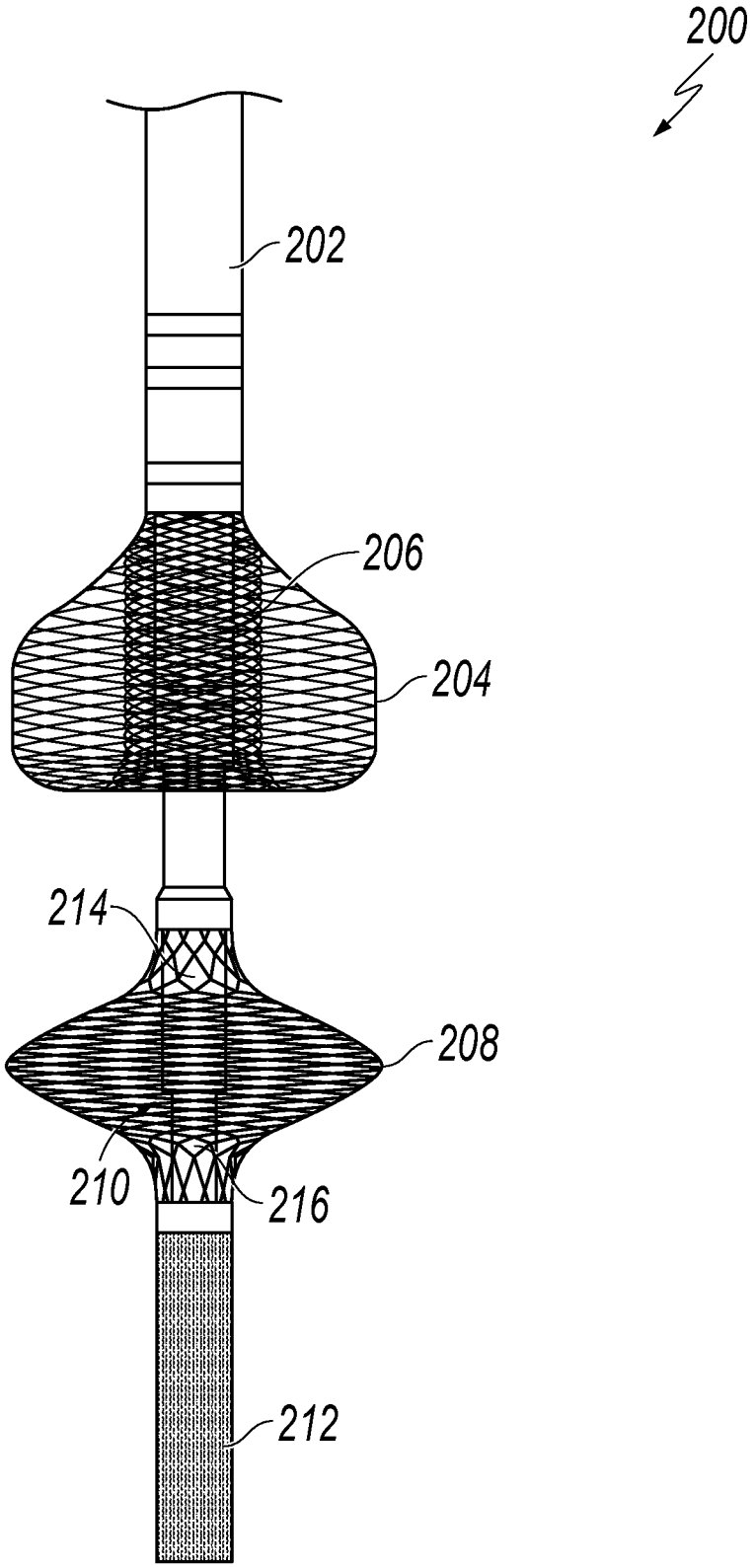
FIG. 2 is a side view of an example wellbore tool.

FIG. 2 is a side view of an example wellbore tool 200. Wellbore tool 200 can be used as wellbore tool 112 previously discussed in FIG. 1. The wellbore tool 200 includes a housing 202. The housing 202 is typically tubular in shape to allow the wellbore tool 200 to easily traverse the typically tubular wellbore 102, but other shapes can be used without departing from this disclosure. The wellbore tool includes a first expandable tubular 204. In some implementations, the first expandable tubular 204 is longitudinally extendable from the housing 202. In some implementations, the first expandable tubular 204 defines an outer portion of the housing 202. The first expandable tubular is expandable to at least a diameter equal to an internal surface of a wellbore 102. A first expander 206 is configured to expand the first expandable tubular 204. Details of example expanders are described later within this disclosure. In some implementations, the wellbore tool 200 includes a second expandable tubular 208. In some implementations, the second expandable tubular 208 can be longitudinally extendable from the housing 202. In some implementations, the second expandable tubular 208 defines an outer portion of the housing 202. The second expandable tubular 208 is expandable up to at least a diameter equal to an internal surface of the wellbore 102. When in an extended position, the second expandable tubular 208 is downhole of the first expandable tubular 204. A second expander 210, separate and distinct from the first expander 206, is configured to expand the second expandable tubular 208. The second expander 210 is downhole of the first expander 206 when the second expandable tubular 208 is in the extended position. The expandable tubular can include a slotted pipe, an expandable screen, a spiraled coil, or any other expandable tubular.

A sensor 212 is downhole of the second expander 210. The sensor 212 is configured to detect a presence of the wellbore obstruction 110 (FIG. 1) proximal to the tool. In some implementations, the sensor can include calipers, transducers, radars, or any other sensors capable of detecting when the tool is in proximity of the blockage. For example, gamma ray, radio wave, or laser based sensors can be used. The distance of the sensor 212 from the blockage 110 when the blockage 110 is detected is dependent on the sensor-type used and the composition of the blockage 110. In some implementations, additional sensors can be included, for example, X-ray diffraction can be used to identify a molecular weight of heavy inorganic parts, such as halite and calcite, and can be used to provide initial screening about the blockage 110.

In some implantations, the first expander 206, the second expander 210, or both, can include the following features. A first cylinder 214 and a second cylinder 216 are arranged coaxially to one another. The first cylinder 214 and the second cylinder 216 are arranged to move between an extended position and a retracted position. The retracted position expands the expandable tubular 204 or 208, and the extended position contracts the expandable tubular 204 or 208. As illustrated in FIG. 2, both the first expander 206 and the second expander 210 are in the retracted position causing both the first expandable tubular 204 and the second expanded tubular 208 to be in an expanded state. Linear electrical actuators or linear hydraulic actuators can be used to extend or retract either the first expander 206, the second expander 210, or both. Other expansion mechanisms can be used without departing from this disclosure. For example a self-expanding tubular can be used. Such an implementation can include a tube (for example, a coil tube or an open-celled tube) made of an elastically deformable material (For example, a super elastic material, such a nitinol). This type of tubular is secured to a downhole tool under tension in an unexpanded state. At the deployment depth, the tubular is released so that internal tension within the tubular causes the tubular to self-expand to its enlarged diameter. Other self-expanding tubulars are made of shape-memory metals. Such shape-memory tubulars experience a phase change at the elevated temperature/pressure downhole. The phase change results in expansion from an unexpanded state to an expanded state. In some implementations, magnetic force can be used to expand or retract the expandable tubular. In such an implementation, the magnetic force is applied the tubular remain in an unexpanded state. Once the magnetic force is removed or the polarity is reversed, the expandable tubular is expanded. Such an implementation can include concentric tubes with opposite charges, similar to the previously described arrangement.

In some implementations, the first expandable tubular 204 and the second expandable tubular 208 are separably longitudinally actuable from one another. For example the first expandable tubular 204 can be expanded against an inner surface of the wellbore to act as an anchor while the second expandable tubular is longitudinally extended through the blockage 110 (FIG. 1). Examples of such operations are described later within this disclosure.

Figure 3:
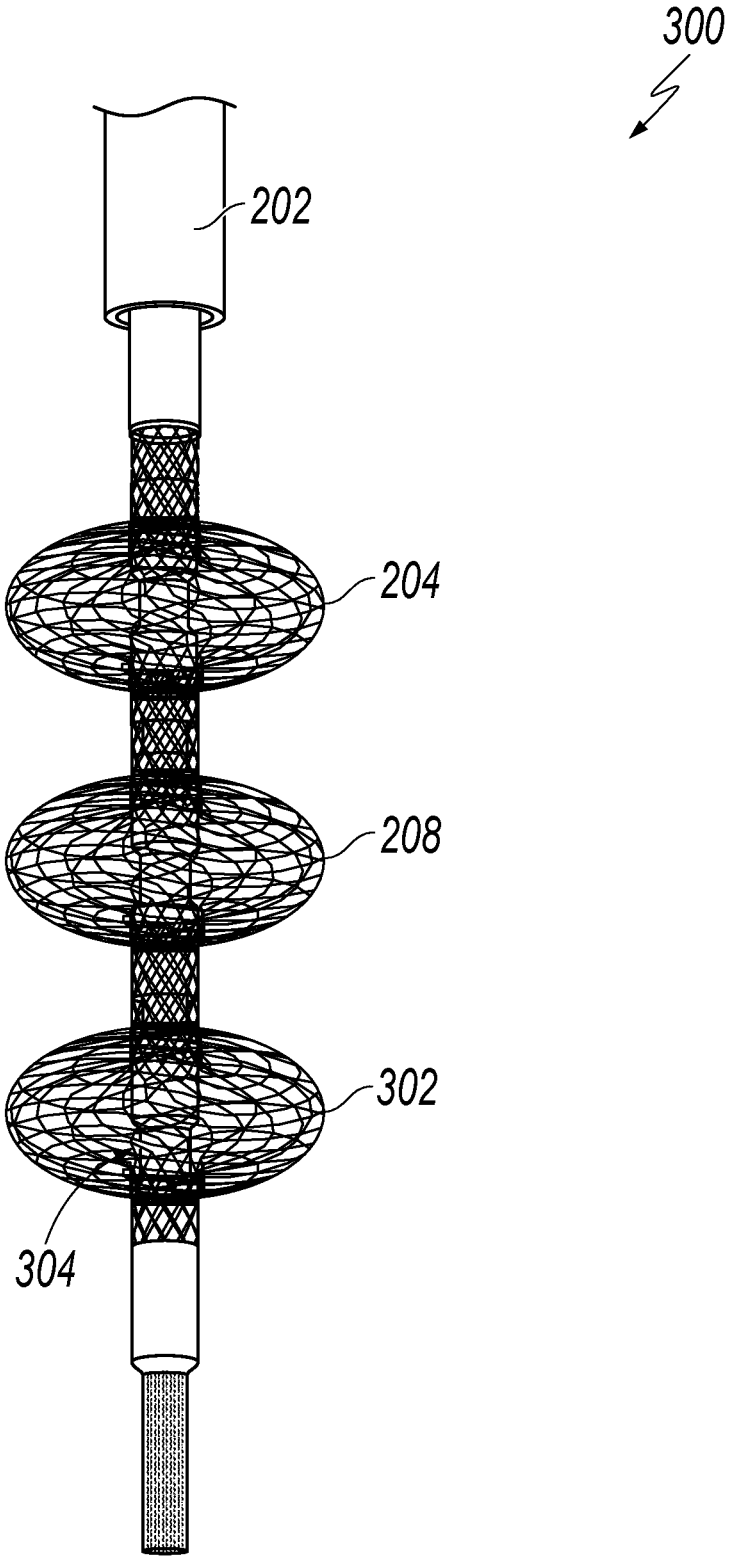
FIG. 3 is a side view of an example wellbore tool.

FIG. 3 is a side view of an example wellbore tool 300. Wellbore tool 200 can be used as wellbore tool 112 previously discussed in FIG. 1. The example wellbore tool 300 is substantially similar to the previously described wellbore tool 200 with the exception of any differences described herein. The wellbore tool 300 includes a third expandable tubular 302 longitudinally extendable from the housing 202. The third expandable tubular 302 is configured is to expand to a diameter equal to an internal surface of the wellbore 102. A third expander 304 is configured to expand the third expandable tubular 302. As illustrated, the first expandable tubular 204, the second expandable tubular 208, and the third expandable tubular 302 are not longitudinally actuable from one another. That is, all three expandable tubulars longitudinally move as a single unit. While previously described as having up to three expandable tubulars, a greater number of expandable tubulars can be used without departing from this disclosure.

Figure 4:
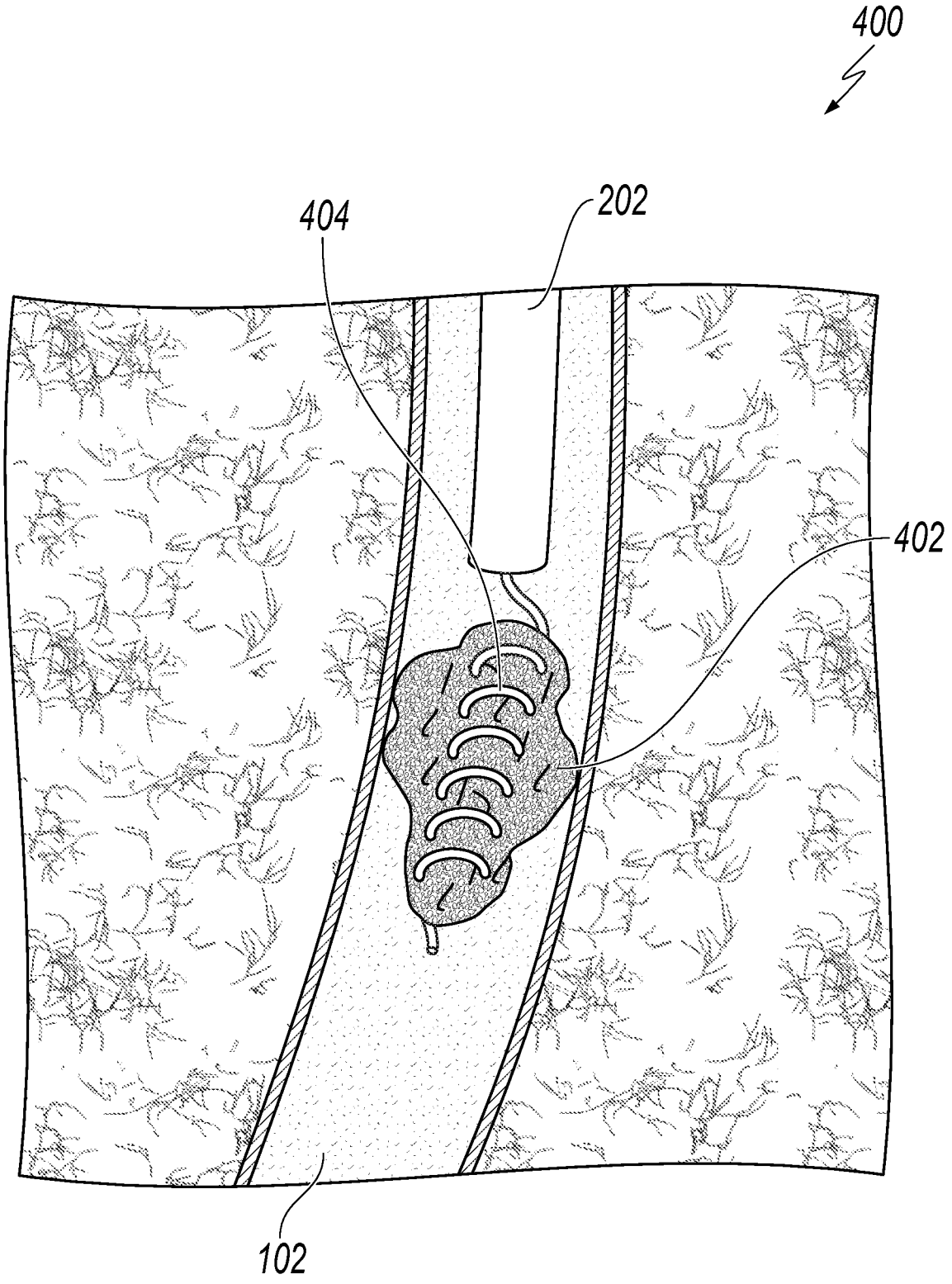
FIG. 4 is a side view of an example wellbore tool.

FIG. 4 is a side view of an example wellbore tool 400. Wellbore tool 400 can be used as wellbore tool 112 previously discussed in FIG. 1. The wellbore tool 400 is substantially similar to wellbore tool 200 previously described with the exception of any differences described herein. The wellbore tool includes a deformable sticky material 402 supported by a coil 404. The coil 404 can be made of any material suitable for downhole operations, such as carbon steel or stainless steel. The sticky material 402 can be a gel suitable for downhole operations that has sufficient viscosity to be supported by the coil 404. The sticky material can be added to the coil 404 prior to the wellbore tool 400 being inserted into the wellbore 102, or it can be pumped out of the housing 202. In such an implantation, the sticky material can be stored within the housing 202 prior to deployment, or can be pumped from the topside facility 106 (FIG. 1).

Figure 5A:
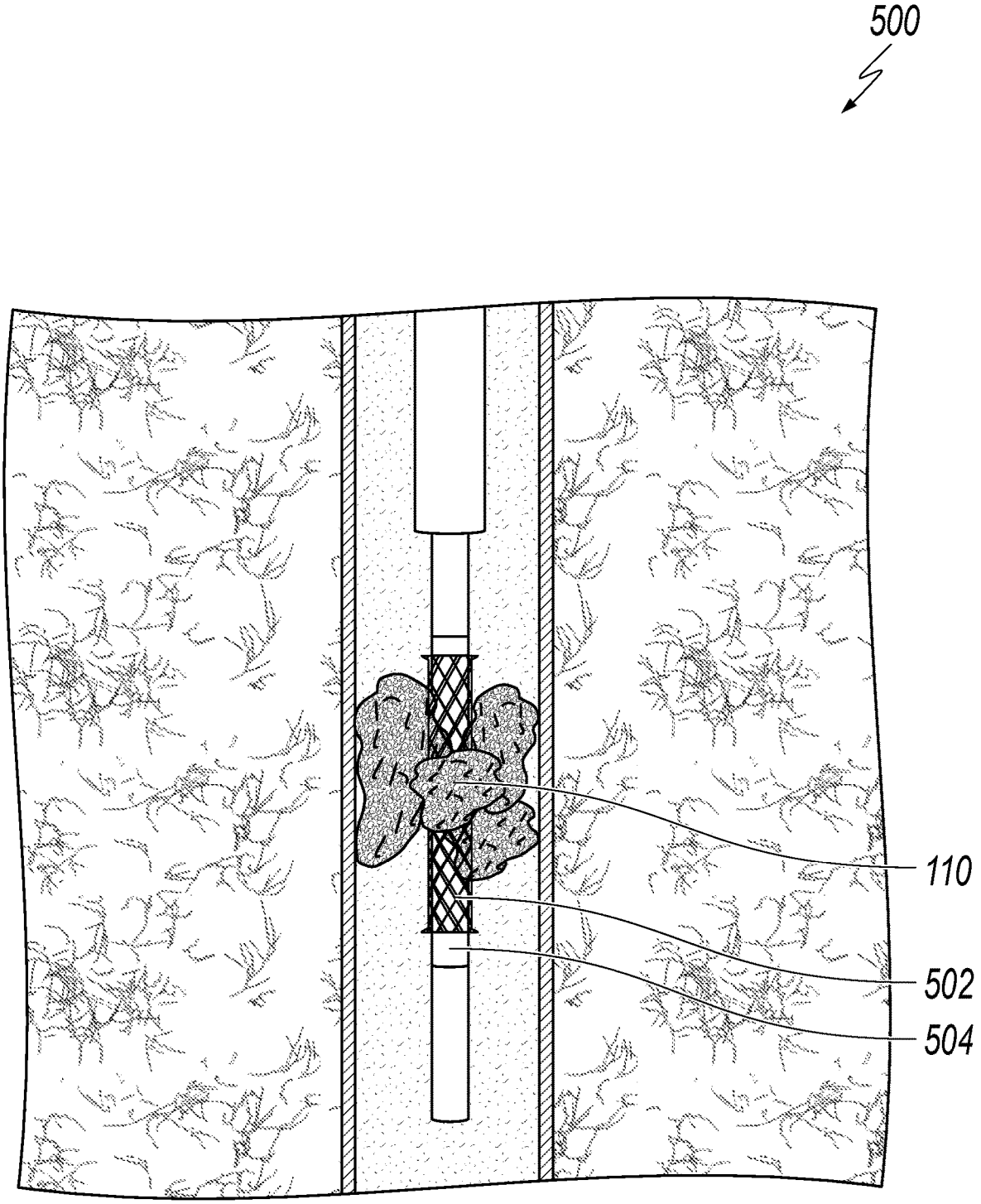
FIGS. 5A-5C are side views of an example wellbore tool in various stages of operation.
Figure 5B:
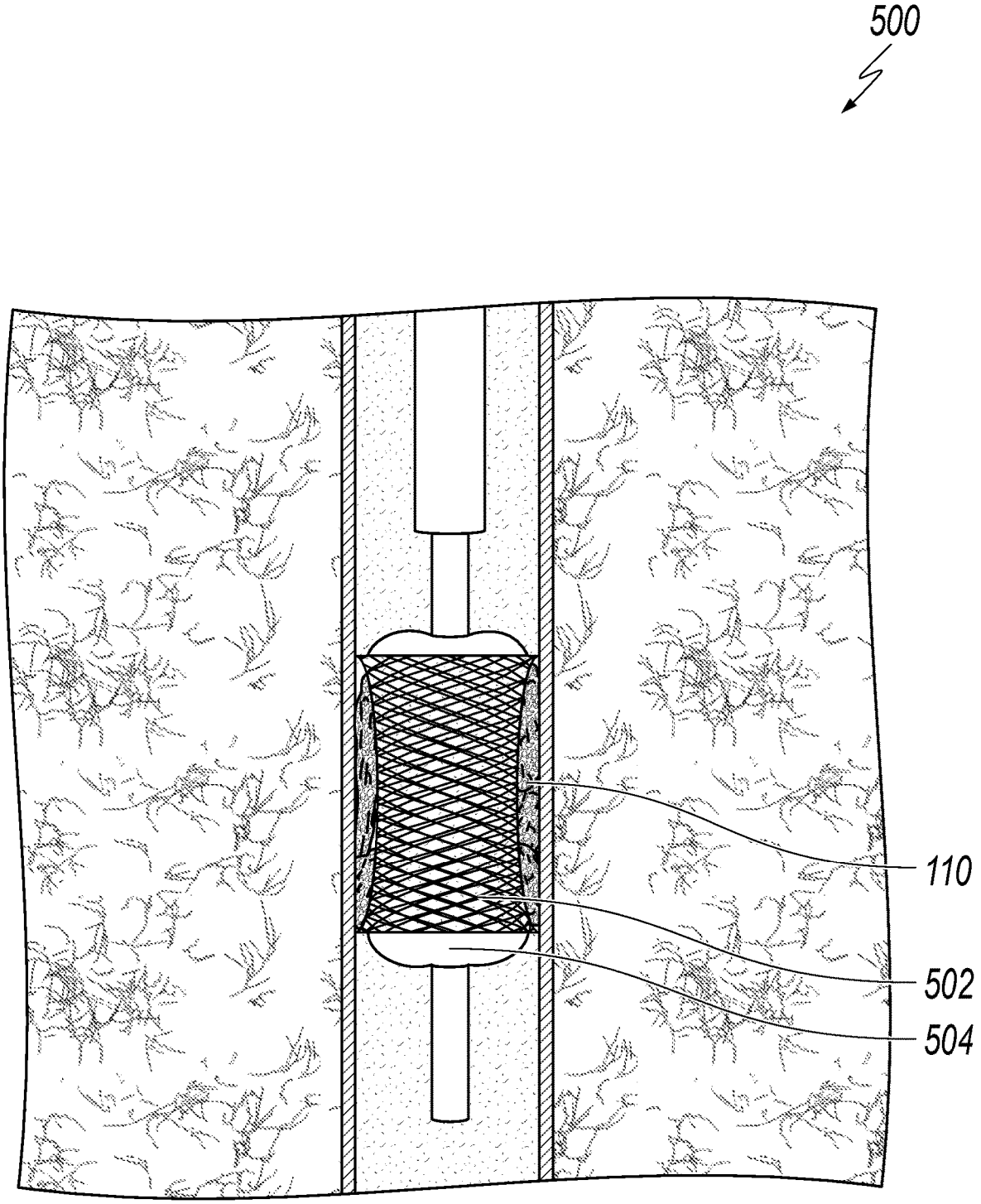
Figure 5C:
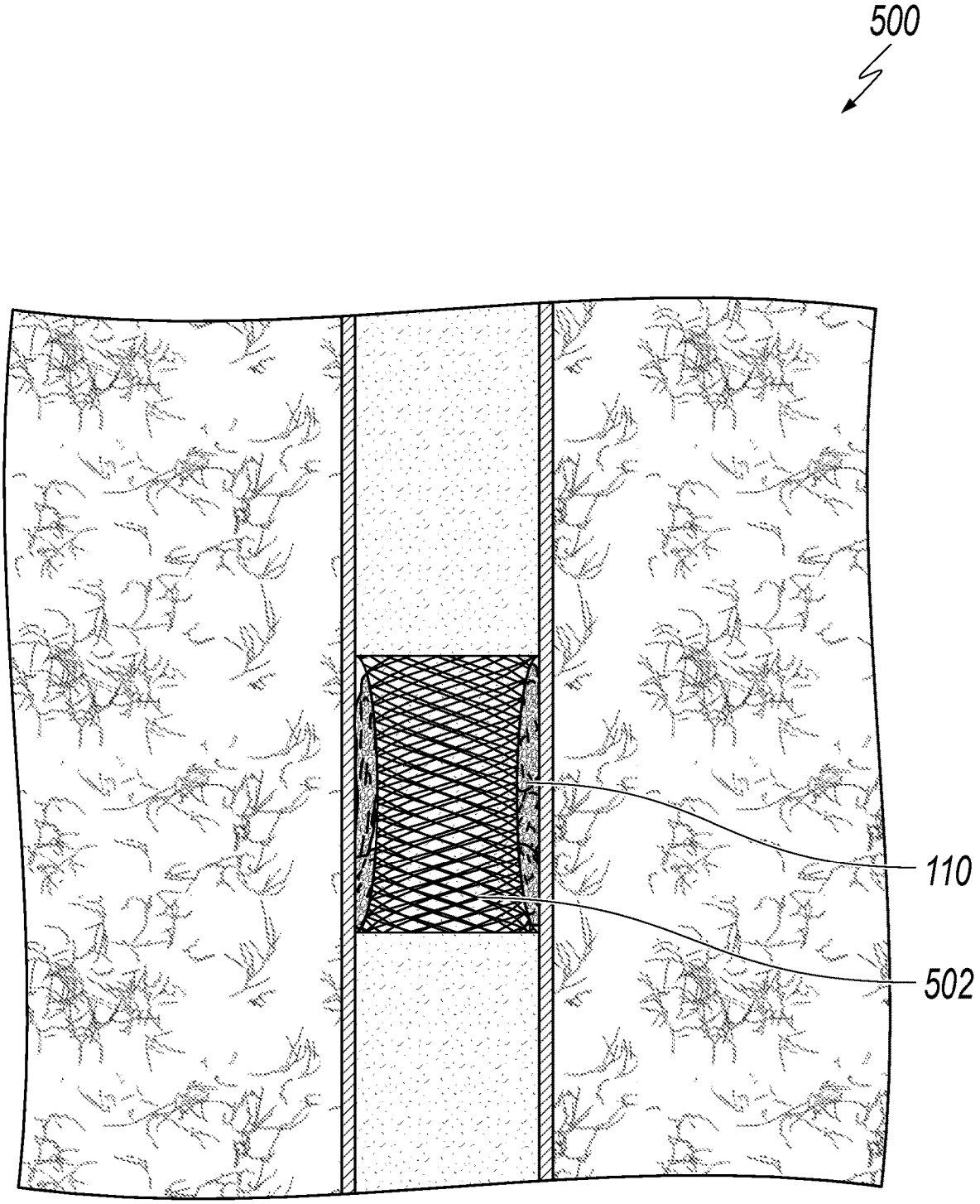

FIGS. 5A-5C are side views of an example wellbore tool 500 in various stages of operation. Wellbore tool 500 can be used as wellbore tool 112 previously discussed in FIG. 1. The wellbore tool 500 is substantially similar to the previously described wellbore tool 200 with the exceptions described herein. An expandable tubular 502 is longitudinally extendable from the housing (FIG. 2). The expandable tubular 502 is configured to expand to a diameter equal to an internal surface of a wellbore 102. The expandable tubular 502 is separable from the wellbore tool after the expandable tubular 502 is expanded. The wellbore tool 500 also includes an expander. The expander includes an inflatable bladder 504 configured to expand the expandable tubular 502. The inflatable bladder 504 can be inflated using wellbore fluid pumped from the wellbore tool 500, fluid supplied by the topside facility, or compressed gas within the wellbore tool 500. Alternatively or in addition, some implementations can include mechanical expansion devices.

In operation, the wellbore tool 500 is received by the wellbore 102 and is placed at a depth substantially equal to (in proximity enough to have an effect when used) the depth of the obstruction 110. Once the wellbore tool 500 is in the proper position, the inflatable bladder 504 is expanded to expand the expandable tubular 502 against the wall of the wellbore 102. The bladder 504 is then contracted and removed from the wellbore 102, and the expandable tubular 502 is released leaving the expandable tubular 502 in place to support the wellbore 102 from further blockage. The remainder of the wellbore tool 500 can be removed once the expandable tubular 502 is released. Separating the expandable tubular can be done using shear pins, or can be caused by removing an interference during expansion. In some implementations, applying higher pressure will break one or more shear pins. In some implementations, additional anchors can be included in the expandable tubular 502 to support the expanded expandable tubular to the wellbore wall. In some implementations, the expandable tubular can be retracted after the operations are completed.

While previously described as separate and distinct implementations, the aspects of the implementations described in FIGS. 1-5C can be combined and interchanged with one another. For example, wellbore tool 200 (FIG. 2) can include a third expandable tubular, similar to wellbore tool 300, that is separable longitudinally actuable from the first expandable tubular 204 and the second expandable tubular 208. Alternatively or in addition, the inflatable bladder 504 can be used as an expander in any implementation described herein.

Figure 6:
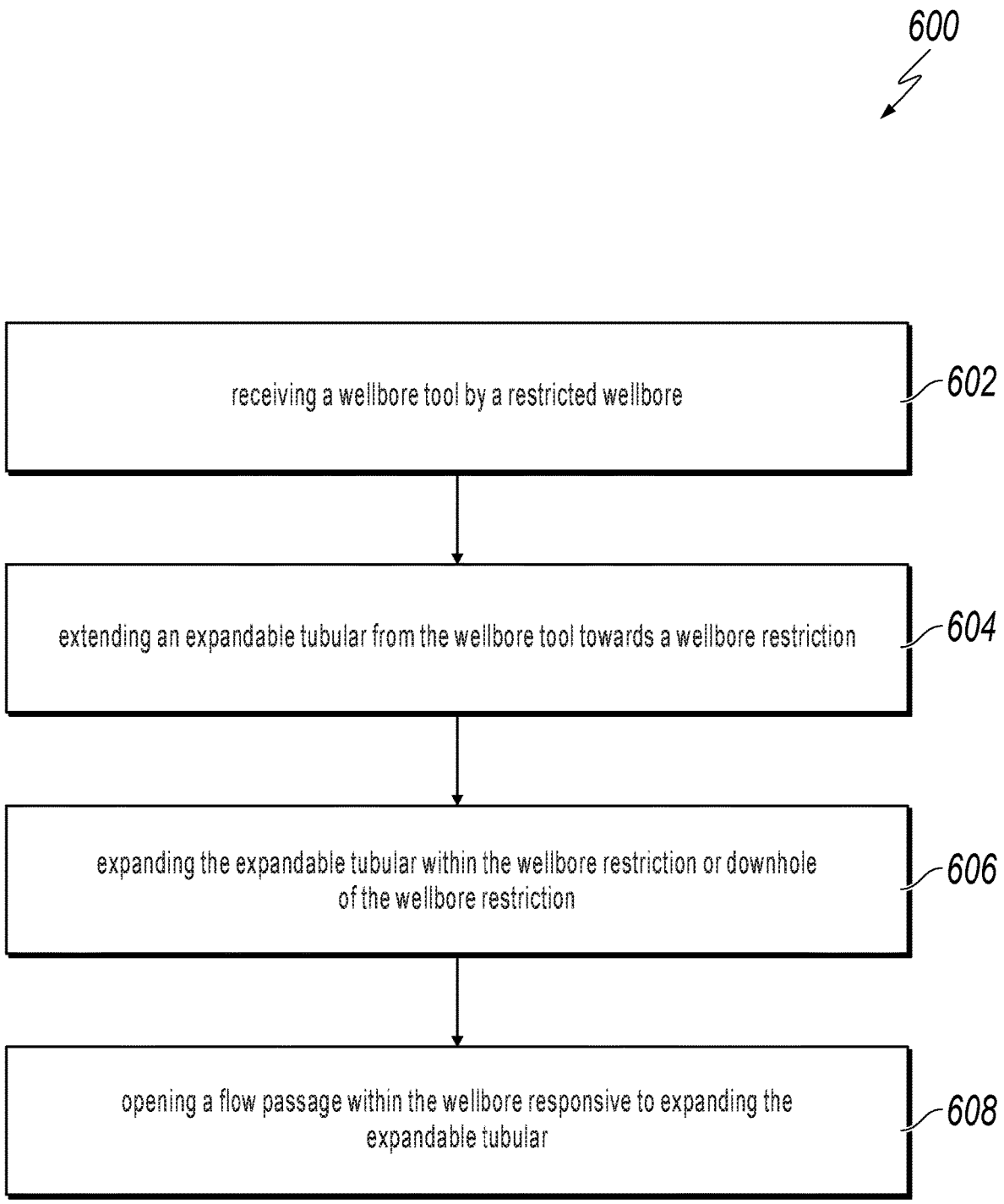
FIG. 6 is a flowchart of a method that can be used with aspects of this disclosure.

FIG. 6 is a flowchart of a method 600 that can be used with aspects of this disclosure. FIGS. 7A-7F show an example wellbore tool 200, first described in FIG. 2, in various stages of operation that track with FIG. 6; however, similar steps can be used to utilize any implementations described herein. At 602, the wellbore tool 200 is received by a restricted wellbore 102.

Figure 7A:
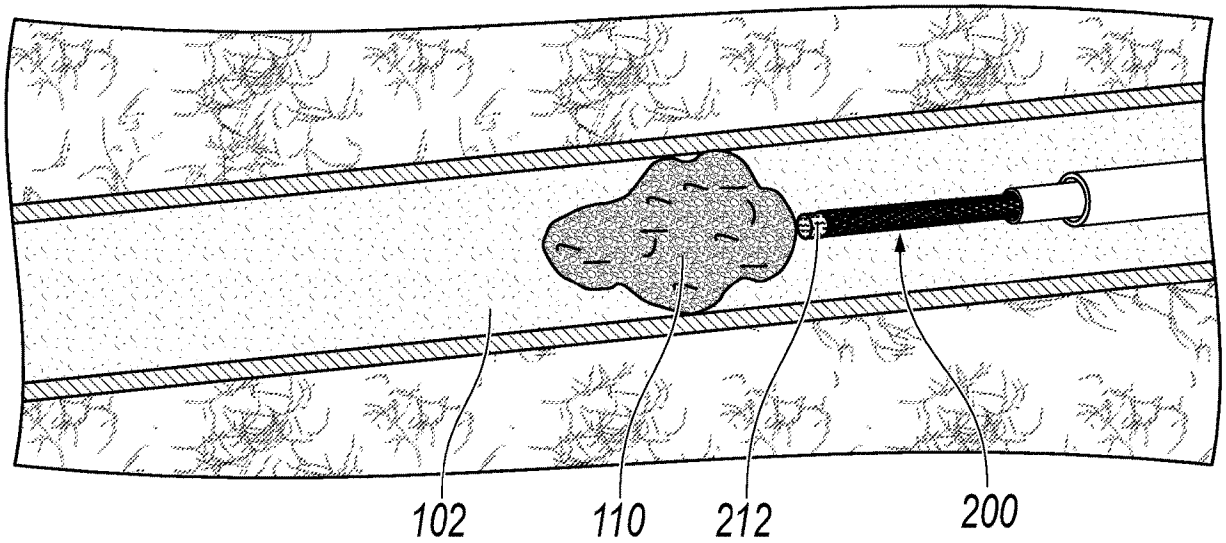
FIGS. 7A-7F show an example wellbore tool in various stages of use.
Figure 7B:
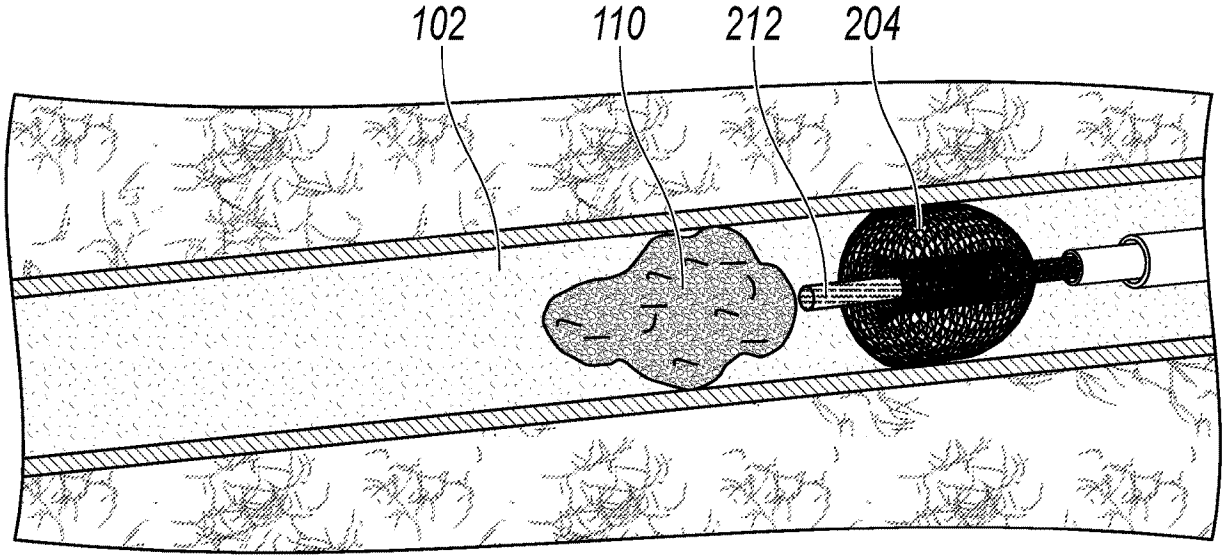
Figure 7C:
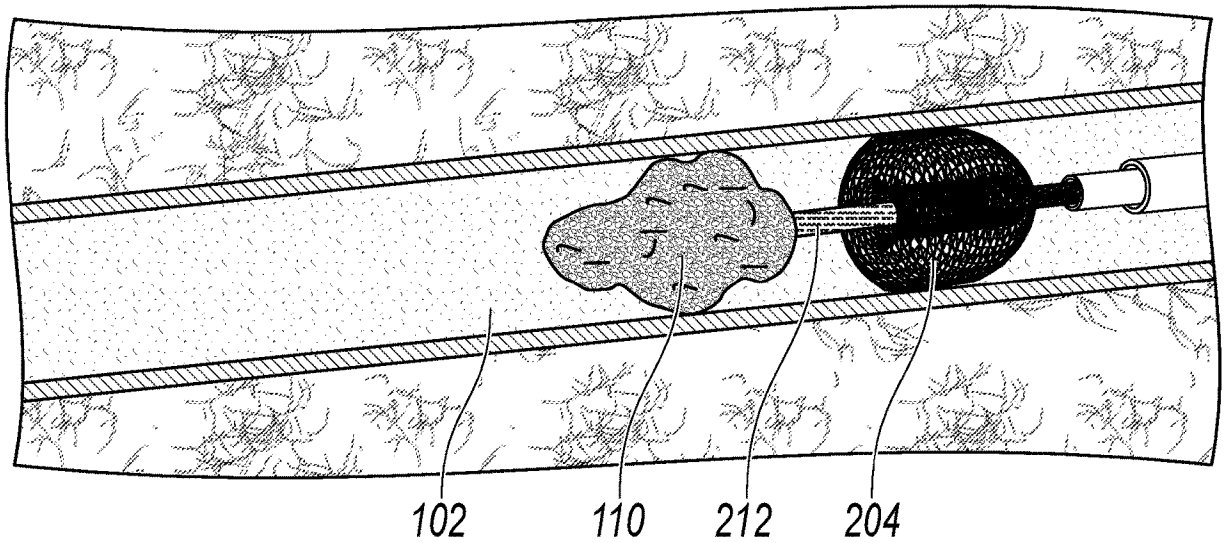
Figure 7D:
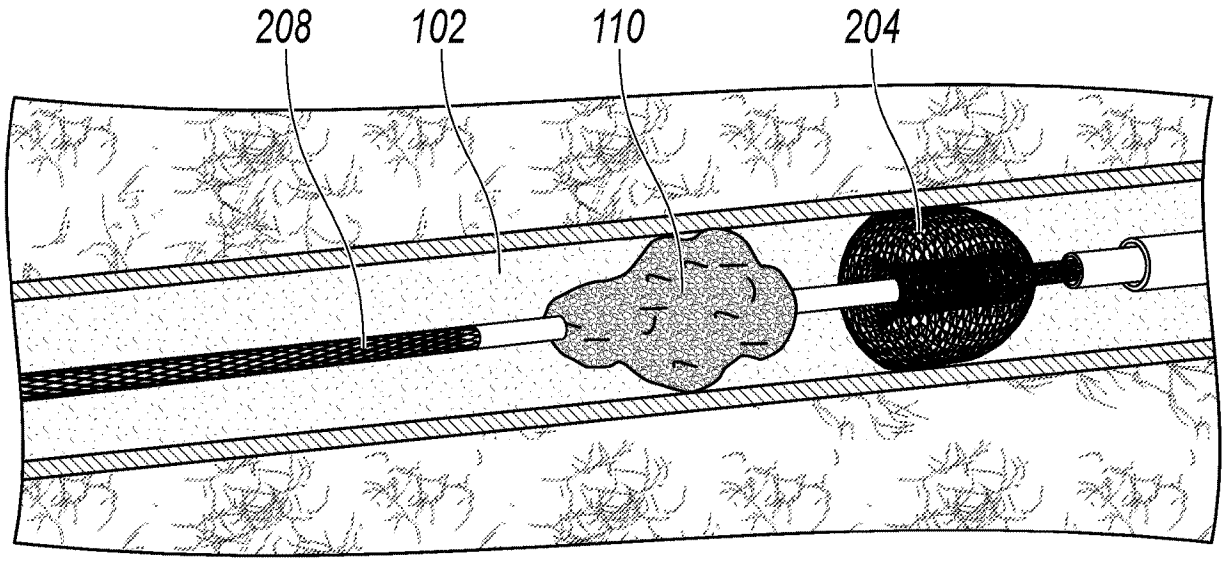

The wellbore tool 200 then traverses the wellbore 102 towards a blockage 110 as shown in FIG. 7A. As shown in FIG. 7B, the first expandable tubular 204 is expanded to press against a wall of the wellbore 102. This expansion helps provide an anchor for the wellbore tool 200. At 604, as shown in FIG. 7C, the second expandable tubular 208 is extended from the wellbore tool towards a wellbore restriction 110. The second expandable tubular can be extended through the blockage 110 such that the second expandable tubular 208 is downhole of the blockage 110, as shown in FIG. 7D.

Figure 7E:
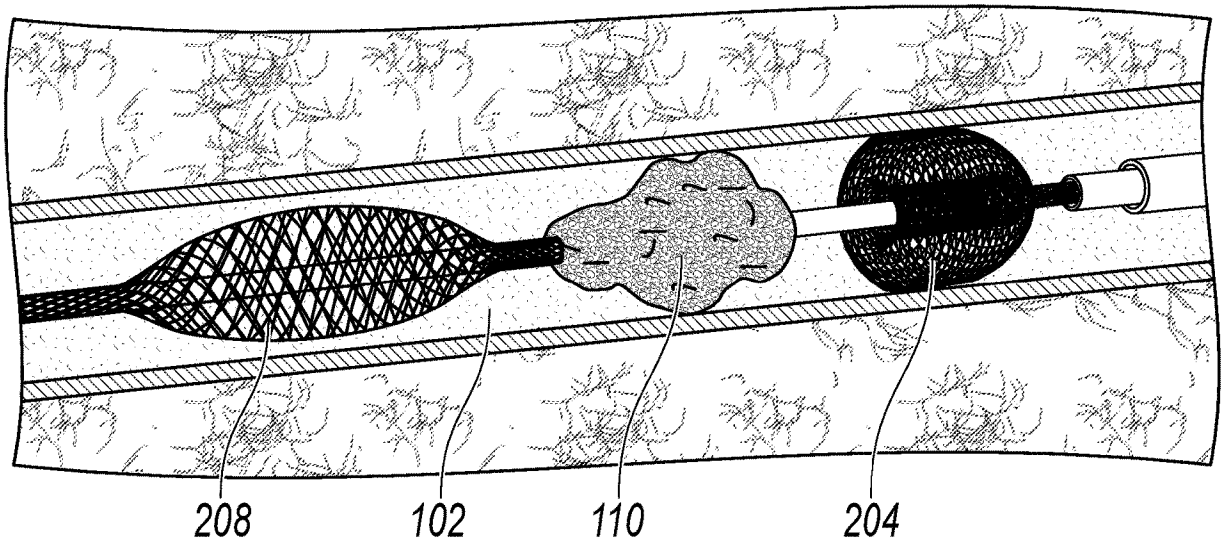
Figure 7F:
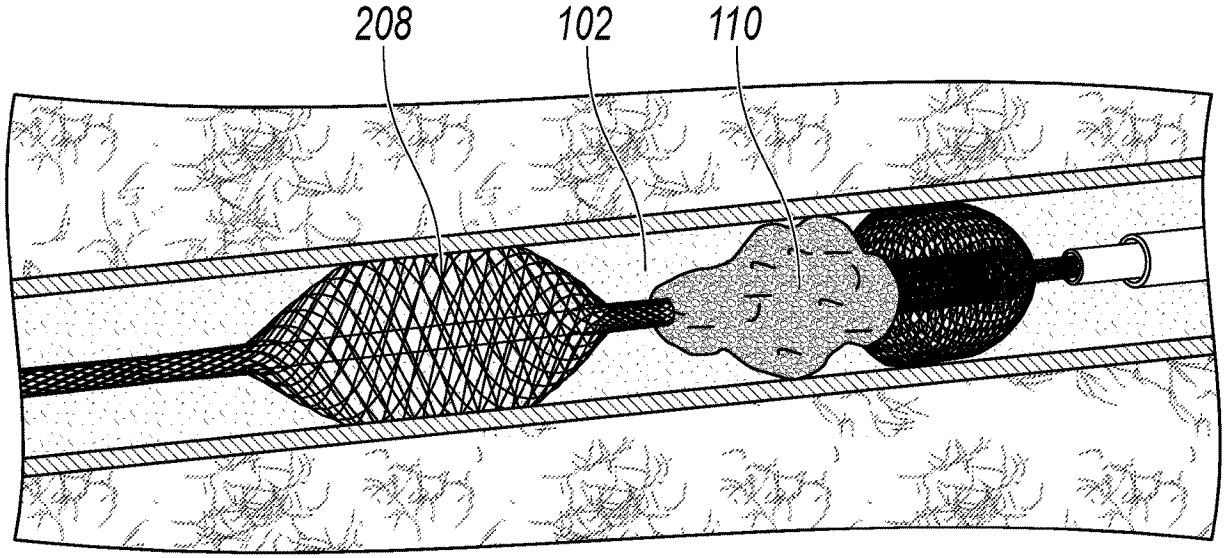

At 606, the second expandable tubular 208 is expanded downhole of the wellbore restriction 110, as shown in FIG. 7E. While illustrated as being expanded downhole of the wellbore restriction, the second expandable tubular 208 can be expanded within the wellbore restriction 110 without departing from this disclosure. In FIG. 7F, the second expanded expandable tubular 208 is retracted toward the first expanded expandable tubular 204. In some implementations, the inner wall of the wellbore is scraped as the second expandable tubular 208 is retracted by the wellbore tool 200. The scraping moves at least a portion of the restriction towards the first expanded expandable tubular 204.

At 608, a flow passage is opened within the wellbore 102. In some implementations, the restriction 110 is retained in an annular space defined by an outer surface of the second expandable tubular 208 and an inner surface of the first expandable tubular 204 as illustrated in FIG. 7F. In some implementations, after the blockage is opened, the expandable tubular and the restriction are retrieved from the wellbore. In some implementations, the material that caused the blockage is left within the wellbore supported by a portion of the wellbore tool as previously described with respect to FIGS. 5A-5C.

Figure 8:
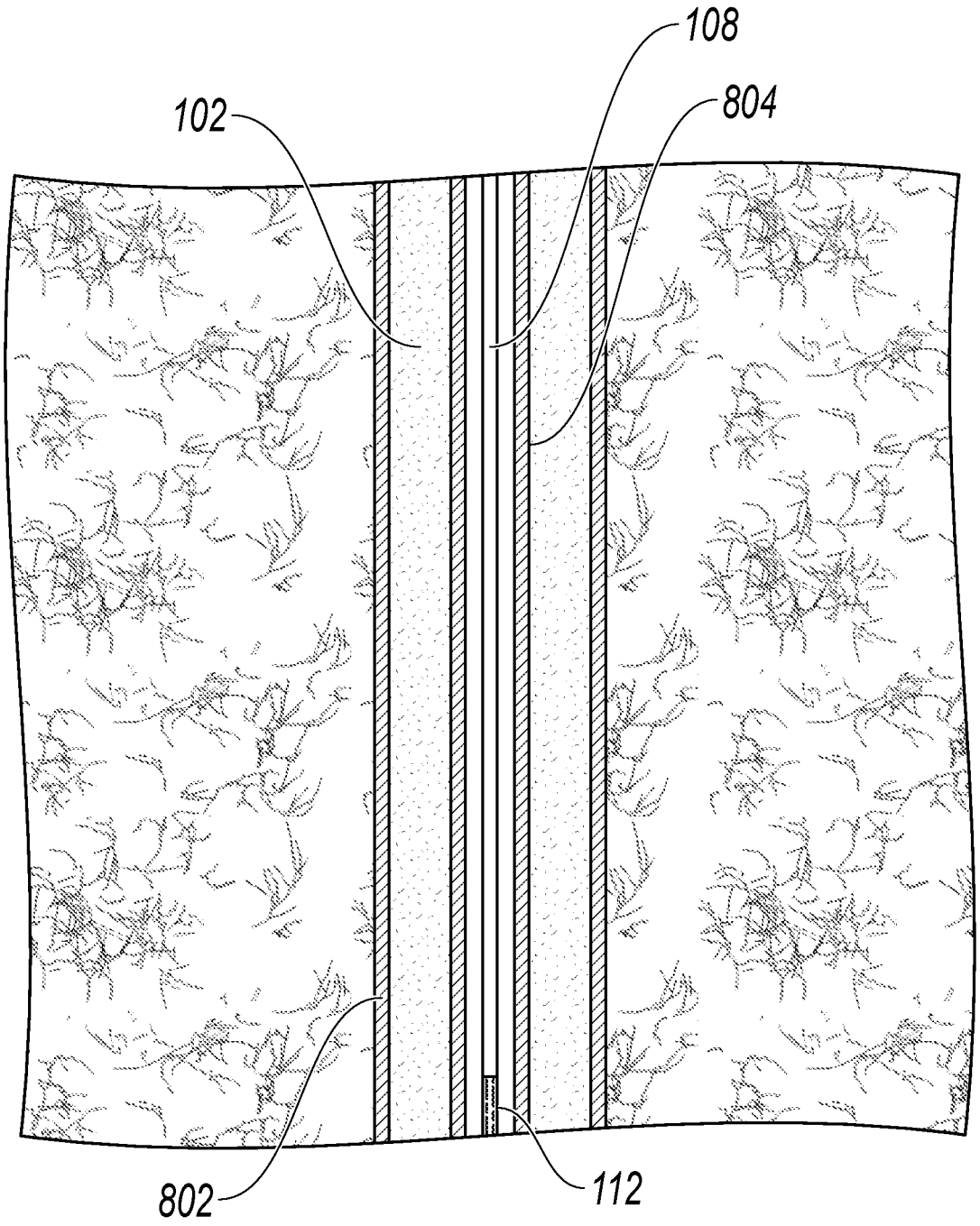
FIG. 8 is a side cross-sectional view of the wellbore tool and the work-string deployed through the installed production tubing.

In some implementations, the wellbore tool 112 can be deployed through the casing 802, the production tubing 804, or any other downhole tubular within the wellbore 102. As illustrated in FIG. 8, the wellbore tool 112 and the work-string 108 can have a diameter such that the wellbore tool 112 and the work-string 108 can be deployed through the installed production tubing 804. While illustrated as being deployed within a cased wellbore with installed production tubing 804, the wellbore tool 112 and work-string 108 can be similarly deployed within open-hole, lined, or production-tube-free wellbores without departing from this disclosure.

Figure 9:
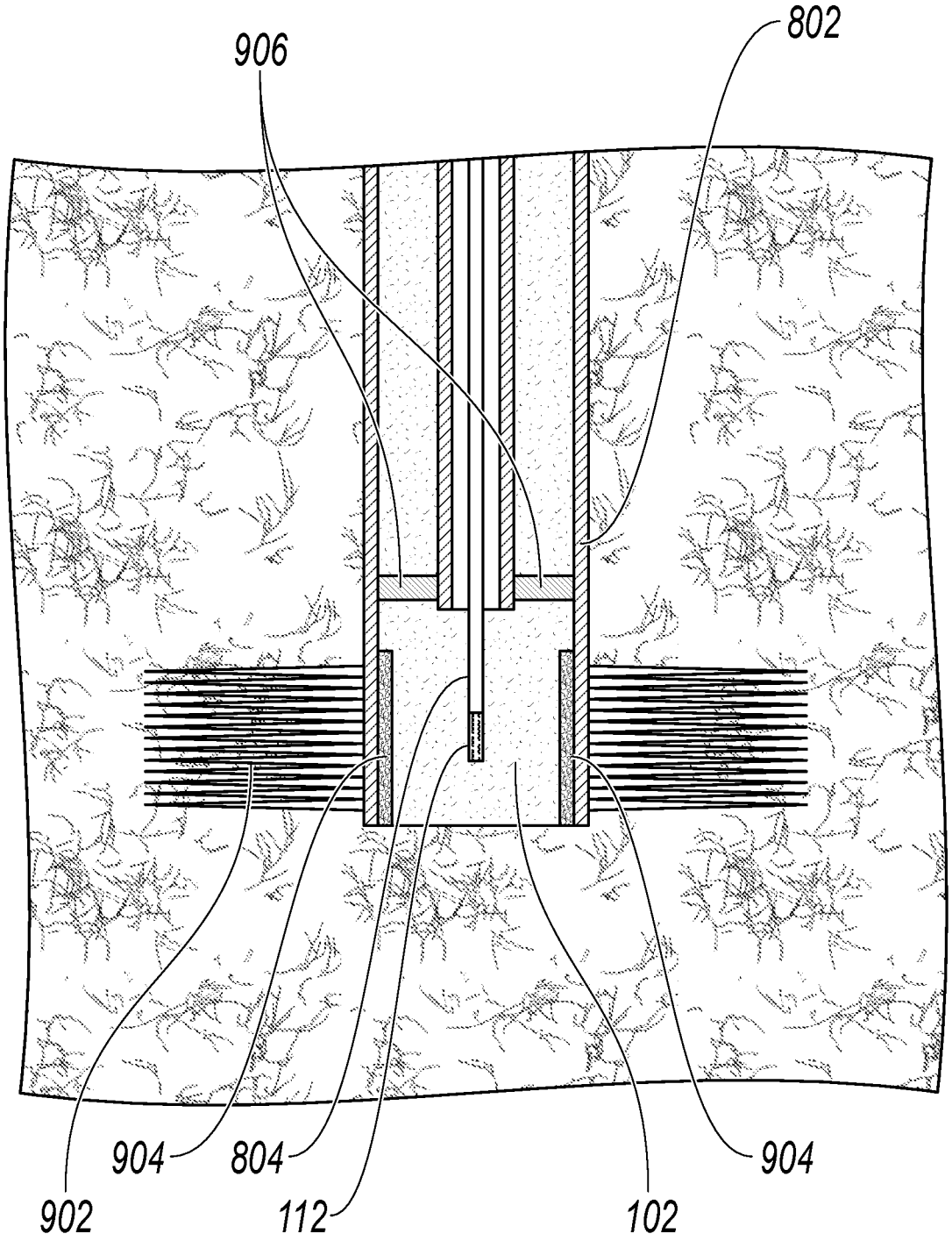
FIG. 9 is a side cross-sectional view of the wellbore tool at a depth substantially equal to perforations within a wellbore.

The wellbore tool 112 and the work-string 108 can be deployed throughout the entire length of the wellbore 102, for example, as illustrated in FIG. 9, at a depth substantially equal to the perforations 902 and downhole of a packer 906. In such an implementation, the wellbore tool 112 is deployed through the production string, such as production tubing 804, and can be expanded to remove blockages that are proximate to the perforations 902. In such an implementation, the wellbore tool 112 can be used to scrape, remove, or both, a blockage proximal to the perforations, such as a skin 904.

Figure 10:
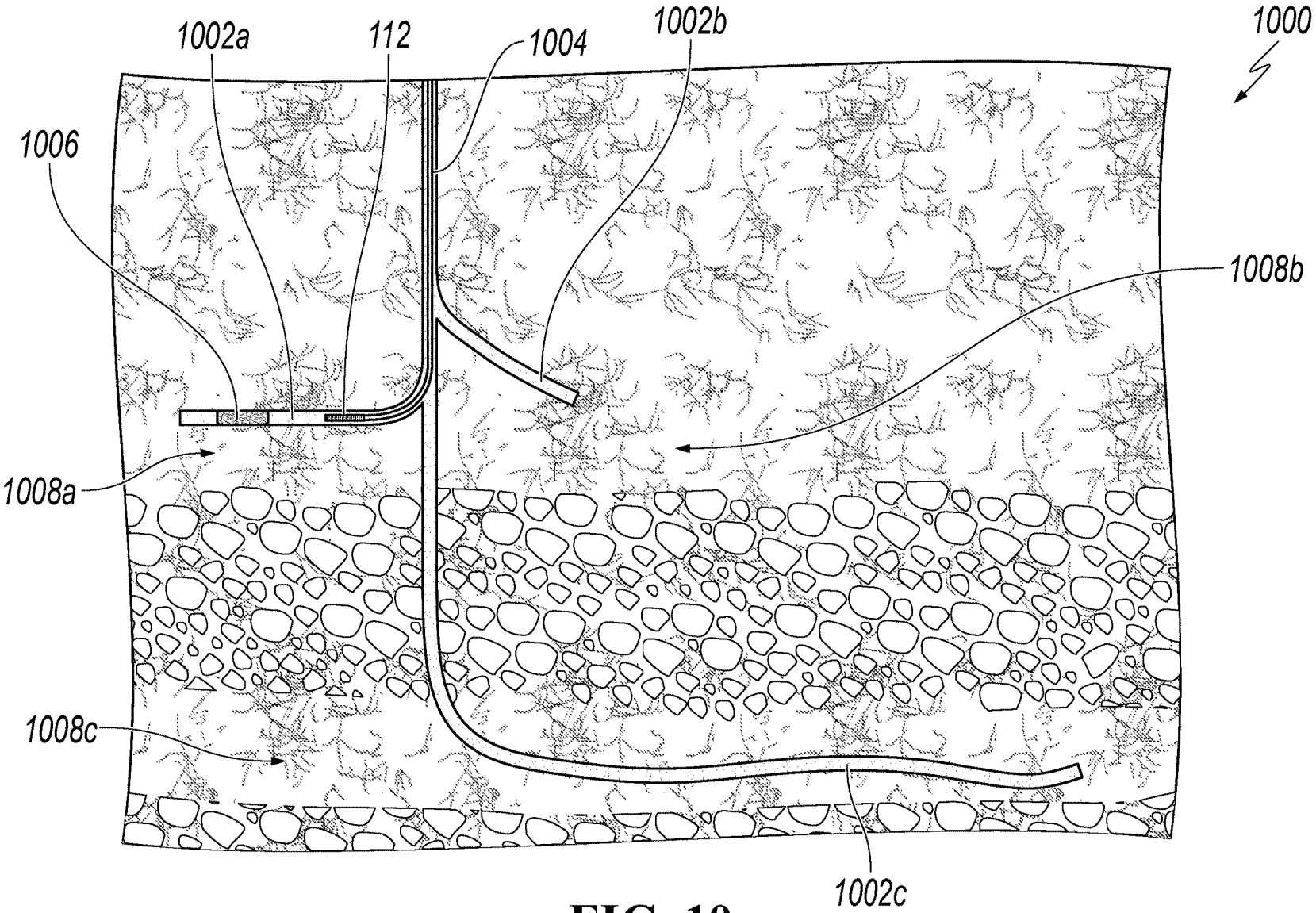
FIG. 10 a side cross-sectional view of an example production reservoir with multiple horizontal (sidetrack) wellbores feeding into a central, main, vertical wellbore while one of the horizontal wellbores undergoes cleaning operations by the wellbore tool.

FIG. 10 shows a side cross-sectional view of an example production reservoir 1000 with multiple horizontal (sidetrack) wellbores 1002 feeding into a central, main, vertical wellbore 1004 while one of the horizontal wellbores 1002 undergoes cleaning operations by the wellbore tool 112. In some implementations, the wellbore tool 112 can be deployed to remove a blockage 1006 within a first sidetrack 1002*a* while the remaining sidetracks (1002*b* and 1002*c*) continue to produce. In such an implementation, each sidetrack 1002 can have individual production tubing to prevent co-mingling of production fluid from individual production zones 1008. In such an instance, the production tubular to the production zone 1008*a*, undergoing cleaning operations by the wellbore tool 112, is isolated while the remaining production zones (1008*b* and 1008*c*) produce through their respective production strings. In some implementations, each sidetrack 1002 feeds into a single production tubular that comingles the fluids from each production zone 1008. In such an implementation, the central production string has a sufficient diameter to both receive the wellbore tool 112 and maintain production from the producing production zones (1008*b* and 1008*c*).

Figure 11:
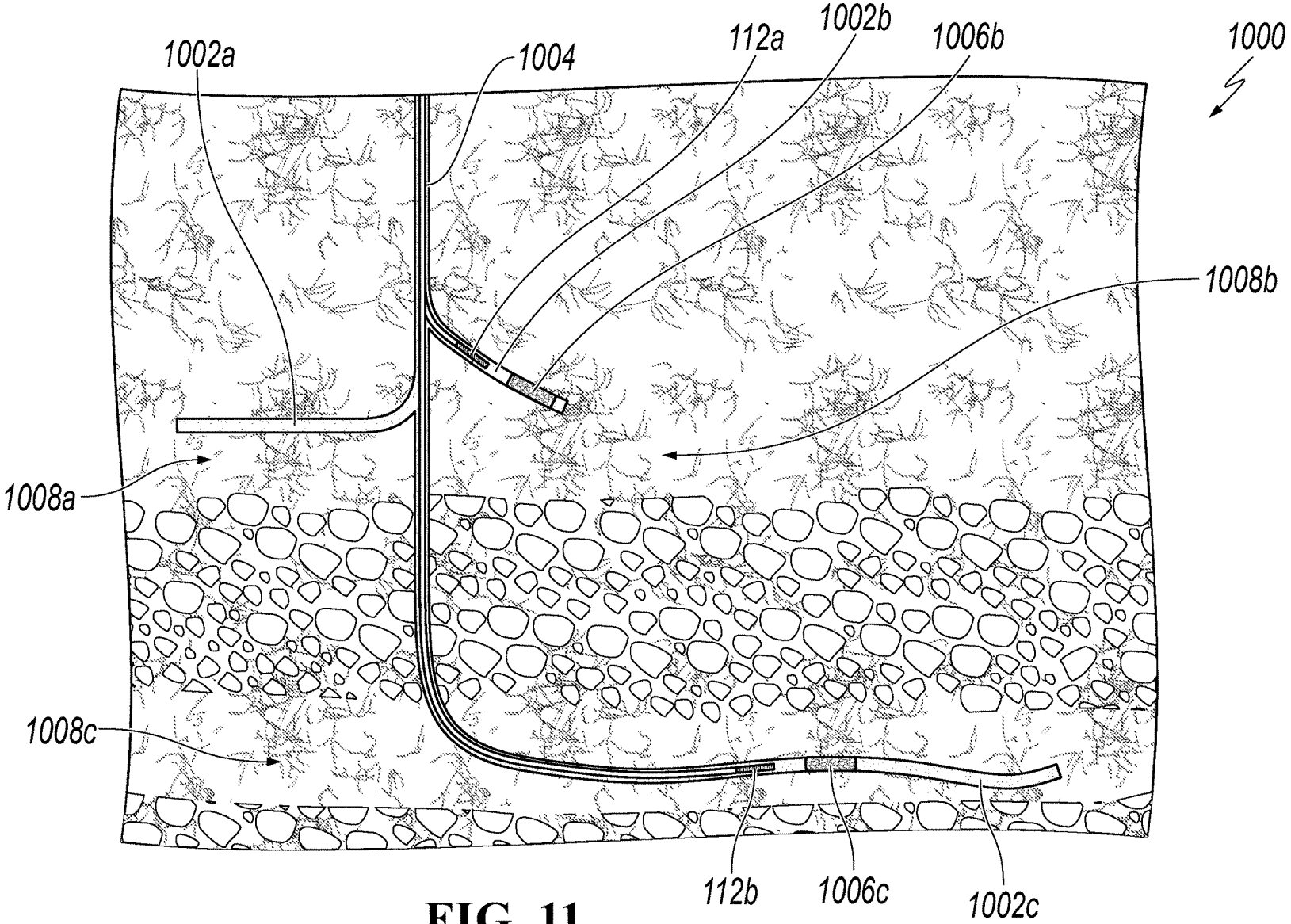
FIG. 11 is a side cross-sectional view of an example production reservoir with multiple horizontal (sidetrack) wellbores feeding into a central, main, vertical wellbore while two of the horizontal wellbores undergoes cleaning operations by the wellbore tool.

FIG. 11 shows a side cross-sectional view of the example production reservoir 1000 with multiple horizontal (sidetrack) wellbores 1002 feeding into a central, main, vertical wellbore 1004 while more than one of the horizontal wellbores undergoes cleaning operations by more than one wellbore tool (112*a*, 112*b*). As illustrated, a second sidetrack 1002*b* and a third sidetrack 1002*c* are undergoing simultaneous cleaning operations to remove respective blockages (1006*b* and 1006*c*) by a first wellbore tool 112*a* and a second wellbore tool 112*b* respectively. The wellbore tool 112 can be used for one or both the first wellbore tool 112*a* or the second wellbore tool 112*b*.

While this disclosure contains many specific implementation details, these should not be construed as limitations on the scope of any inventions or of what may be claimed, but rather as descriptions of features specific to particular implementations of particular inventions. Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination. For example, the expander described with respect to FIG. 2 can be used for an expandable tubular while the expander described with respect to FIGS. 5A-5C can be used on a second expandable tubular within the same wellbore tool. In some implementations, suction can be included to improve the obstruction removal process. In some implementations, multi-lateral and dual expandable tubular designs can be used as needed Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations described above should not be understood as requiring such separation in all implementations, and it should be understood that the described components and systems can generally be integrated together in a single product or packaged into multiple products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A wellbore tool comprising:

a housing;

a first expandable tubular longitudinally extendable from the housing, the first expandable tubular being expandable to a diameter equal to an internal surface of a wellbore;

a first expander configured to expand the expandable tubular;

a second expandable tubular longitudinally extendable from the housing, the second expandable tubular configured to expand to a diameter equal to an internal surface of the wellbore, the second expandable tubular being downhole of the first expandable tubular;

a second expander configured to expand the second expandable tubular, the second expander being downhole of the first expander, wherein the first or second expander comprises an inflatable bladder; and a sensor downhole of the second expander, the sensor configured to detect a presence of a wellbore obstruction proximal to the tool.

2. The wellbore tool of claim 1, wherein the first or the second expandable tubular is separable from the wellbore tool.

3. The wellbore tool of claim 1, wherein the first expandable tubular and the second expandable tubular are separably longitudinally actuable from one another.

4. The wellbore tool of claim 1, further comprising:

a third expandable tubular longitudinally extendable from the housing, the second expandable tubular configured to expand to a diameter equal to an internal surface of the wellbore; and a third expander configured to expand the second expandable tubular.

5. The wellbore tool of claim 1, wherein the first or second expandable tubular comprises a deformable sticky material.

6. A wellbore tool comprising:

a housing;

a first expandable tubular longitudinally extendable from the housing, the first expandable tubular being expandable to a diameter equal to an internal surface of a wellbore;

a first expander configured to expand the expandable tubular;

a second expandable tubular longitudinally extendable from the housing, the second expandable tubular configured to expand to a diameter equal to an internal surface of the wellbore, the second expandable tubular being downhole of the first expandable tubular;

a second expander configured to expand the second expandable tubular, the second expander being downhole of the first expander, wherein the first or second expander comprises:

a first cylinder; and a second cylinder coaxial to the first cylinder, the first cylinder and the second cylinder arranged to move between an extended position and a retracted position, the retracted position expanding the expandable tubular and the extended position contracting the expandable tubular; and a sensor downhole of the second expander, the sensor configured to detect a presence of a wellbore obstruction proximal to the tool.

7. The wellbore tool of claim 6, wherein the first expandable tubular and the second expandable tubular are separably longitudinally actuable from one another.

8. The wellbore tool of claim 6, further comprising:

a third expandable tubular longitudinally extendable from the housing, the second expandable tubular configured to expand to a diameter equal to an internal surface of the wellbore; and a third expander configured to expand the second expandable tubular.

9. The wellbore tool of claim 6, wherein the first or second expandable tubular comprises a deformable sticky material.

10. A method comprising:

receiving a wellbore tool by a restricted wellbore;

extending an expandable tubular from the wellbore tool towards a wellbore restriction;

expanding the expandable tubular within the wellbore restriction or downhole of the wellbore restriction;

opening a flow passage within the wellbore responsive to expanding the expandable tubular, wherein the expandable tubular is a first expandable tubular;

extending a second expandable tubular from the wellbore tool downhole of the first expandable tubular;

expanding the second expandable tubular;

retracting the second expanded expandable tubular toward the first expanded expandable tubular;

scraping an inner wall of the wellbore responsive to retracting the second expandable tubular; and moving at least a portion of the restriction towards the first expanded expandable tubular in response to retracting the second expanded expandable tubular.

11. The method of claim 10, further comprising retaining the restriction in an annular space defined by an outer surface of the second expandable tubular and an inner surface of the first expandable tubular.

12. The method of claim 10, wherein expanding the expandable tubular comprises inflating a bladder within the expandable tubular.

13. The method of claim 10, further comprising:

releasing the expandable tubular from the wellbore tool; and retrieving the wellbore tool.

14. The method of claim 10, further comprising retaining the restriction in an annular space defined by an outer surface of the expandable tubular and an inner surface of the wellbore.

15. The method of claim 14, further comprising retrieving the expandable tubular and the restriction from the wellbore.

16. A wellbore system comprising:

a restricted wellbore; and a wellbore tool within the restricted wellbore, the wellbore tool comprising:

a housing;

an expandable tubular longitudinally extendable from the housing, the expandable tubular configured to expand to a diameter equal to an internal surface of a wellbore, the expandable tubular separable from the wellbore tool after the expandable tubular is expanded;

an expander comprising an inflatable bladder configured to expand the expandable tubular; and a sensor configured to detect a presence of a wellbore obstruction proximal to the tool.

17. The wellbore system of claim 16, wherein the expandable tubular is a first expandable tubular and the expander is a first expander, the wellbore tool further comprising:

a second expandable tubular longitudinally extendable from the housing, the second expandable tubular configured to expand to a diameter equal to an internal surface of the wellbore; and a second expander configured to expand the second expandable tubular.

18. The wellbore system of claim 17, further comprising:

a third expandable tubular longitudinally extendable from the housing, the third expandable tubular configured to expand to a diameter equal to an internal surface of the wellbore; and a third expander configured to expand the third expandable tubular.

19. The wellbore system of claim 16, wherein the second expandable tubular and the second expander separably longitudinally actuable independent from one-another.

20. The wellbore system of claim 16, wherein the second expander comprises:

a first cylinder; and a second cylinder coaxial to the first cylinder, the first cylinder and the second cylinder arranged to move between an extended position and a retracted position, the retracted position expanding the expandable tubular and the extended position contracting the expandable tubular.

* * * * *